US008435144B2

(12) United States Patent
Asherman

(10) Patent No.: US 8,435,144 B2
(45) Date of Patent: May 7, 2013

(54) PIVOTING CUTTING ELEMENTS FOR PROJECTILES

(76) Inventor: Richard E. Asherman, Cody, WY (US)

( * ) Notice: Subject to any disclaimer, the term of this patent is extended or adjusted under 35 U.S.C. 154(b) by 0 days.

(21) Appl. No.: 13/416,147

(22) Filed: Mar. 9, 2012

(65) Prior Publication Data

US 2012/0231907 A1 Sep. 13, 2012

Related U.S. Application Data

(60) Provisional application No. 61/451,875, filed on Mar. 11, 2011.

(51) Int. Cl.
*F42B 6/08* (2006.01)

(52) U.S. Cl.
USPC ..... 473/583

(58) Field of Classification Search ..... 473/583, 473/584
See application file for complete search history.

(56) References Cited

U.S. PATENT DOCUMENTS 834,442 A 10/1906 Aungst
2,568,417 A * 9/1951 Steinbacher ..... 473/583
3,578,328 A 5/1971 Rickey
5,046,744 A * 9/1991 Eddy ..... 473/583
5,178,398 A 1/1993 Eddy
5,458,341 A 10/1995 Forrest et al.
7,377,869 B2 * 5/2008 Wohlfeil et al. ..... 473/583
2010/0004078 A1 1/2010 Flanagan

OTHER PUBLICATIONS

PCT International Search Report and Written Opinion in Application PCT/US2012/028431, mailed Jun. 26, 2012, 11 pages.

* cited by examiner

*Primary Examiner* — John Ricci
(74) *Attorney, Agent, or Firm* — Merchant & Gould P.C.

(57) ABSTRACT

A blade system for a projectile includes a body having a front portion and a rear portion and an axis extending axially from the front portion to the rear portion. At least one blade is pivotably secured to the body. The blade includes an outer cutting edge and an inner cutting edge. The blade also includes a lever proximate a rear portion of the blade. An application of a force to the lever, for example as the lever contacts the skin, hide, or bone of an animal, pivots the blade from a closed position toward an open position. The lever has an unsharpened leading edge to prevent cutting of the target animal tissue to help ensure pivoting of the blade.

13 Claims, 6 Drawing Sheets

PIVOTING CUTTING ELEMENTS FOR PROJECTILES

CROSS-REFERENCE TO RELATED APPLICATIONS

This application claims priority to and the benefit of U.S. Provisional Patent Application Ser. No. 61/451,875, filed Mar. 11, 2011, entitled "Pivoting Cutting Elements for Projectiles," the disclosure of which is hereby incorporated by reference herein in its entirety.

INTRODUCTION

Mechanical broadhead arrowheads ("mechanical broadheads") are used for hunting and are configured to expand upon impact with the hide or skin of a target animal. This expansion increases the cutting diameter of the broadhead as it penetrates the target, ideally resulting in more humane kills. Many mechanical broadheads include one or more blades pivotably engaged with an arrowhead body proximate a rear portion of the blade. Leading contact edges of each blade are positioned towards the front of the arrowhead and contact the hide or skin of a target as the arrowhead tip penetrates the hide or skin surface. This contact compels pivoting movement of each blade, thus extending the blades away from the body of the arrowhead. This pivoting movement exposes a sharp inner edge of the blade that cuts the tissue of the target. Once open, the blades are forced through the hide or skin of the target as the projectile travels further into the target. As a result, known mechanical broadheads lose significant kinetic energy as the extended blades penetrate the hide. This problem is exacerbated on larger targets like big game, targets with thick hide or hair, or when the projectile contacts the target proximate bone. Indeed, if the leading edges contact bone proximate the outer hide (for example, the ribs), the blades may open prior to significant penetration of the arrow into the target, thus reducing lethality.

Another type of mechanical broadhead 100 is depicted in FIGS. 1A and 1B. The broadhead 100 may be attached to an arrow shaft, via a threaded connection 106. The broadhead 100 includes a leading arrowhead or tip 104 and two or more blades 106 located within a slot 108. The blades 106 include a lever portion 110 and a cutting portion 112. A leading edge 110*a* of the lever portion 110 and a cutting surface 112*a* of the cutting portion 112 are sharpened. The blades 106 are pivotably connected to a body 114 of the broadhead 100 at a pivot connection proximate a rear portion of the blade 106. A retention member 116 holds the blades 106 in the closed position, as depicted in FIG. 1A.

When the broadhead 100 first penetrates a target, the arrowhead 104 and the body 114 form a puncture wound within the target. As the broadhead 100 further penetrates the target, the leading edge 110*a* of the lever portion 110 contacts the hide. Under desirable conditions, the force applied by this contact against the lever portion 110 compels the blades 106 to pivot, thus exposing the cutting edges 112*a* of the cutting portion 112. This pivoting P breaks the retention member 116 and the blades 106 open to the position depicted in FIG. 1B. There is a risk, however, that the broadhead 100 may not open as desired. Since the arrowhead 104 forms only a puncture wound as it penetrates the target, the leading edges 110*a* of the lever portions 110 are sharpened, allowing those elements to cut the tissue of the target. Should the blades 106 fail to open (due to lack of contact with denser muscle or bone), the broadhead 100 should still inflict a degree of damage to the target. This damage is not, however, as significant as damage inflicted by the exposed cutting portions 112. Accordingly, further improvements of mechanical broadheads are still desirable.

SUMMARY

In one aspect, the technology relates to a blade system for a projectile, the blade system including: a body having a front portion and a rear portion and an axis extending axially from the front portion to the rear portion; a blade pivotably secured to the body, wherein the blade includes: an outer cutting edge; an inner cutting edge; and a lever proximate a rear portion of the blade, wherein an application of a force to the lever pivots the blade from a closed position toward an open position, wherein the lever comprises an unsharpened leading edge. In an embodiment, the body is adapted to be secured to at least one of an arrow shaft and an arrowhead. In another embodiment, the body is integral with at least one of an arrow shaft and an arrowhead. In yet another embodiment, when in the closed position, the inner cutting edge is located proximate the axis. In still another embodiment, the body defines a slot, wherein when in the closed position, the inner cutting edge is located within the slot and the outer cutting edge is exposed.

In another embodiment of the above aspect, when in the open position, the inner cutting edge extends substantially orthogonal from the axis. In another embodiment, the blade system further includes a retention element for releasably holding the blade in the closed position. In yet another embodiment, the blade system of claim 1, further includes a breakable retention member, and the blade includes a notch, wherein the retention member is located in the notch when the blade is in the closed position. In still another embodiment, the retention member is adapted to break when the blade moves from the closed position to an intermediate position. In another embodiment, the blade includes a plurality of blades. In another embodiment, the blade system includes a spring for biasing the blade toward the open position.

In another aspect, the technology relates to an arrow including the blade system described herein. In another aspect, the technology relates to an arrowhead including the blade system described herein.

BRIEF DESCRIPTION OF THE DRAWINGS

There are shown in the drawings, embodiments which are presently preferred, it being understood, however, that the technology is not limited to the precise arrangements and instrumentalities shown.

DETAILED DESCRIPTION

Figure 1A:
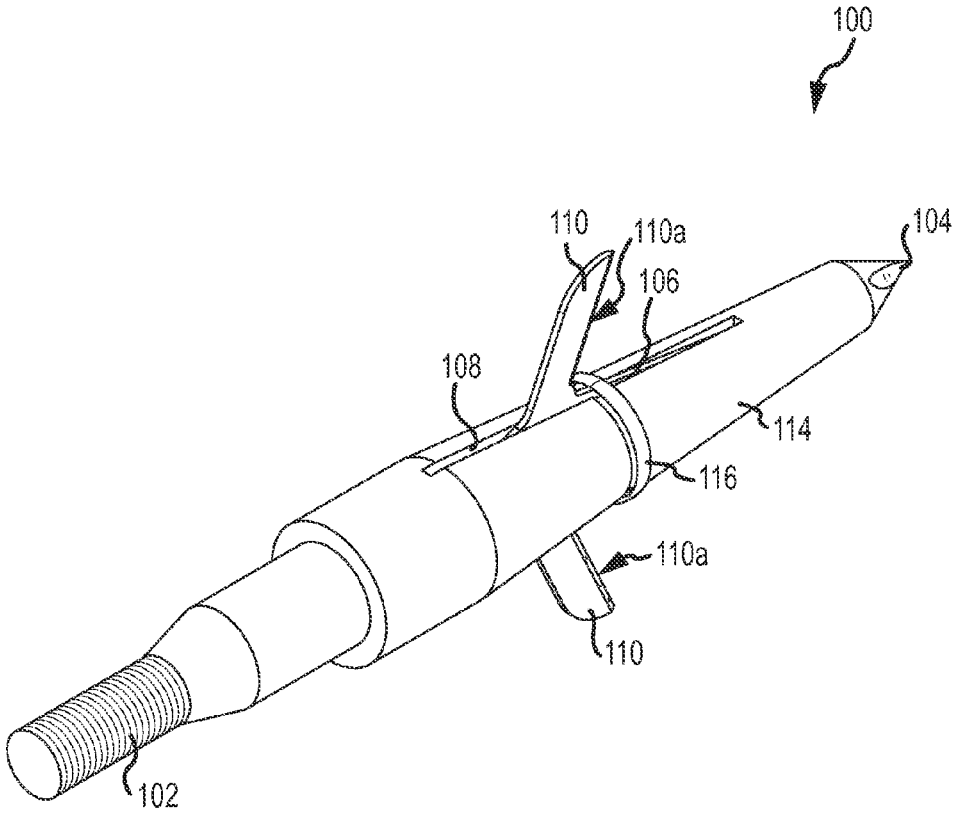
FIG.1A PRIOR ART
FIGS. 1A-1B are rear perspective views of a prior art mechanical broadhead, in a closed position and an open position, respectively.
Figure 1B:
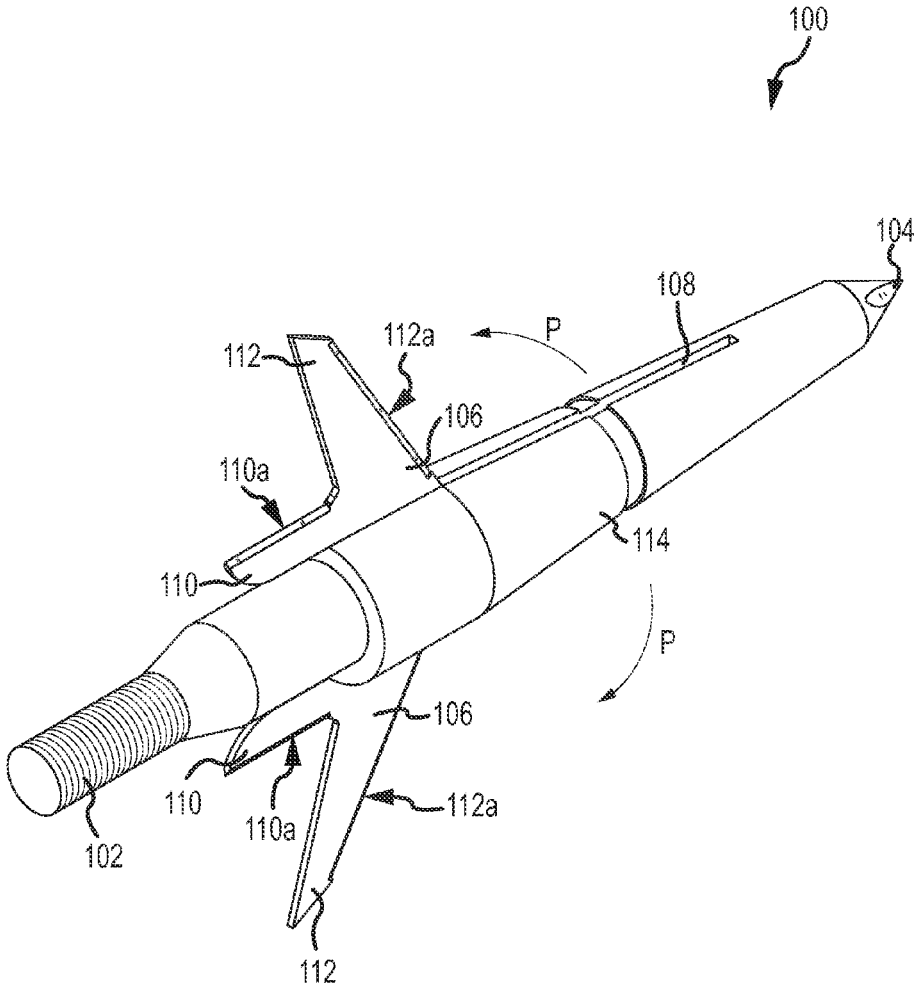
FIG.1B PRIOR ART
Figure 2A:
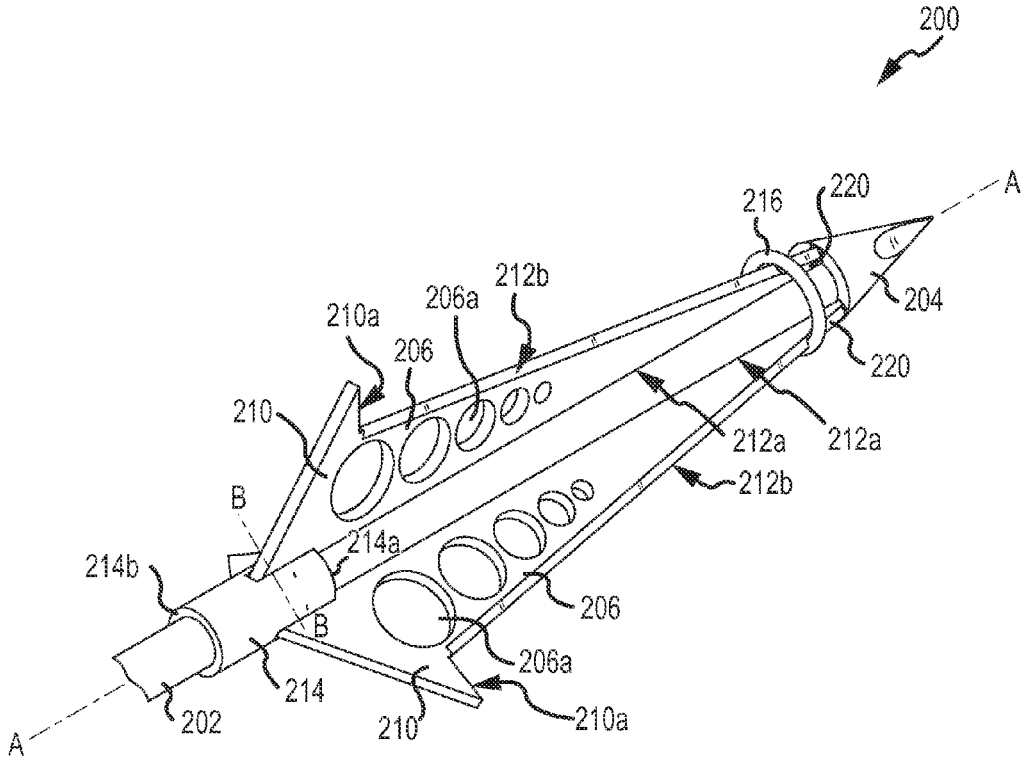
FIGS. 2A-2C are rear perspective views of a mechanical broadhead in a closed position, an intermediate position, and an open position, respectively.
Figure 2B:
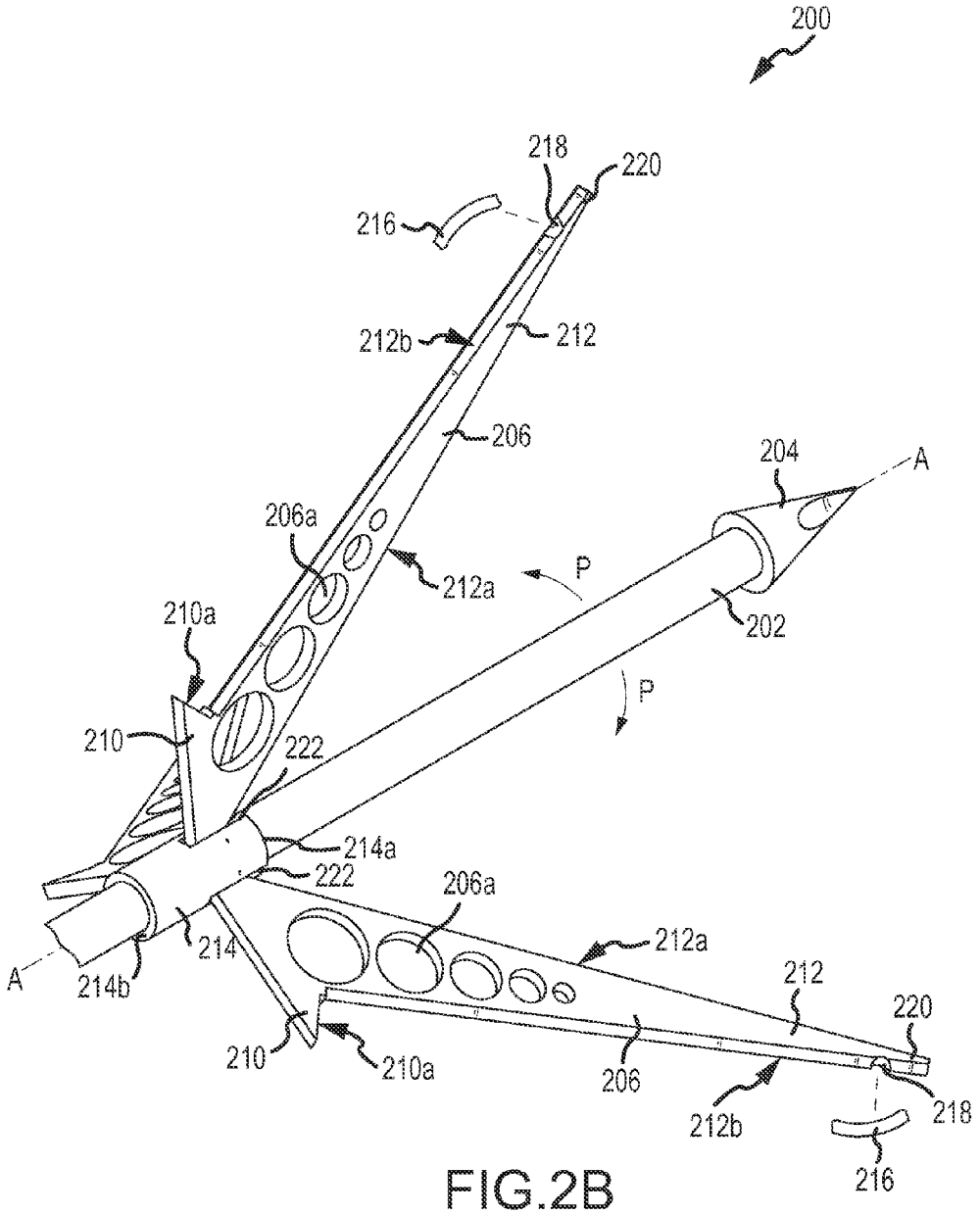
Figure 2C:
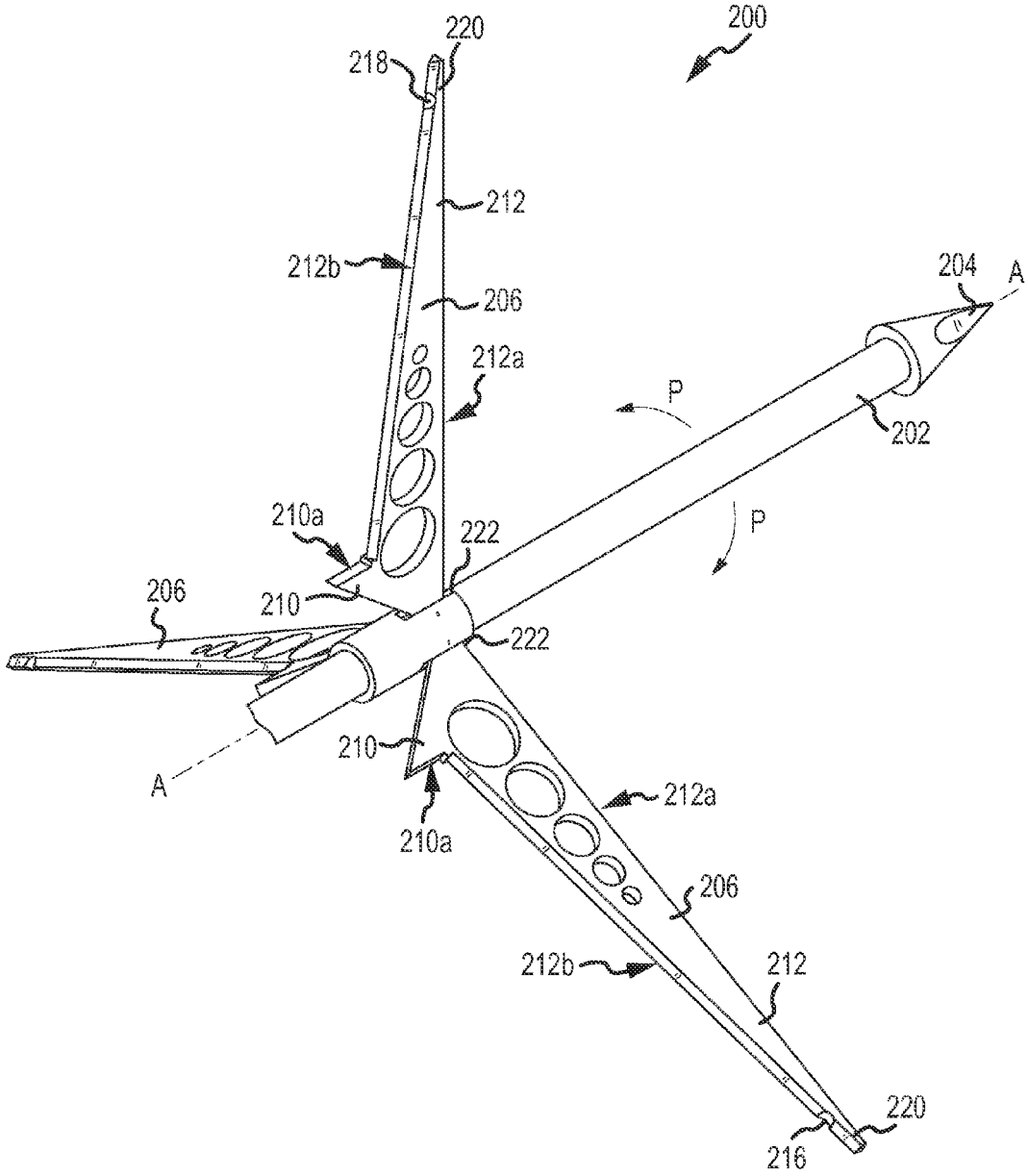

FIGS. 2A-2C are partial perspective views of an arrow having a mechanical broadhead or expandable blade system 200. Although the following embodiments of the expandable blade system are described in the context of arrows, the technologies described herein may also be incorporated into bolts or quarrels for crossbows or for other types of substantially elongate projectiles launched from other implements. The figures depict the blade system 200 in a closed position (FIG.

2A), an intermediate position (FIG. 2B), and an open position (FIG. 2C). In the figures, the blade system 200 includes a body 214 that substantially surrounds an arrow shaft 202, but other embodiments are contemplated. For example, the blade system may be an element that is integral with the arrow shaft. In another embodiment, the rear portion of the blade system body may be secured to a front end of an arrow shaft with a threaded, press fit, and/or chemical adhesive connection. An arrowhead or tip may be secured to a front portion of the body with a similar or different connection. In another embodiment, the blade system may be integral with an arrowhead, such that the arrowhead/blade unit may be secured to a front end of the arrow shaft. In still another embodiment, the blade system may be completely integrated with the arrow shaft.

Returning to the figures, the body 214 includes a front portion 214*a*, a rear portion 214*b*, and an axis A. In the depicted embodiment, the front portion 214*a* is located just beyond a pivot point (defined by an axis B) of the blades 206. In alternative embodiments, the front portion of the body may extend closer to or to touch an arrowhead. Each blade 206 includes a lever portion 210 and a cutting portion 212, which may be formed as a unitary part or discrete from each other. In the latter embodiment, the lever portion may be secured to the cutting portion with mechanical and/or chemical fasteners. In this case, the body 214 defines a slot 222 or recess for receiving an inner edge 212*a* of the cutting portion 212 of the blade 206 when the blade 206 is in the closed or non-deployed position. An outer edge 212*b* of the cutting portion 212 projects away from the axis A, so as to be exposed. The distance from the outer edge 212*b* of the cutting portion 212 to the axis A increases as a distance from the arrowhead 204 increases. The outer edge 212*b* may define a notch 218 configured to receive a retention member 216 or other element when the blade 206 is in the closed position. The blade 206 may also define a number of through-holes 206*a* or openings that reduce the weight of the blade 206. In the depicted embodiment, both the inner edge 212*a* and the outer edge 212*b* are sharp to facilitate cutting of the target. In other embodiments, only the outer edge of the blade may be sharp though this may limit the cutting ability of the blades when deployed. The blade 206 is connected at a pivot pin proximate the rear portion of the blade 206. Also located near a rear portion of the blade 206 is a lever portion 210. When a force is applied to the lever portion 210 (as described in more detail below), the blade 206 is urged to pivot about the axis B defined by the pivot pin. In the embodiment depicted in FIGS. 2A-2C, a leading edge 210*a* of the lever portion 210 is not sharp.

Operation of the depicted blade system 200 is described below, again in conjunction with FIGS. 2A-2C. FIG. 2A depicts the blade system 200 in the closed position. In the closed position, the inner edges 212*a* of each blade 206 are located proximate and substantially parallel to the axis A of the body 214, within the slots 222. The retention member 216 is located within the notches 218 so as to hold the leading tips 220 of the blades 206 in the closed position. During aiming, release, flight, and initial penetration of the arrow into the target, the blade system 200 is in the closed position. Initial penetration of the arrow begins with penetration of the arrowhead 204 into the hide of a target animal. As the arrowhead 204 travels further into the hide, the sharp outer edges 212*b* of the blades 206 cut the hide and outer muscles of the animal. This is a particular advantage over other expanding broadheads that do not have exposed outer blade edges. In such broadheads, initial penetration of the arrow causes only a puncture wound, prior to opening of the blade system. In the depicted embodiment however, the outer edges 212*b* of the blades 206 cause a cutting wound during initial penetration. This increases the initial lethality of the arrow strike, generally resulting in a cleaner, more humane kill.

FIG. 2B depicts the blade system 200 in an intermediate position. This intermediate position may be defined as any position between the closed position and the open position, described below. In general, the intermediate position may be any position in which the blades 206 are located, after rupture of the retention element 216, but prior to reaching the open position. The initial penetration phase ends when the forward advancement of the arrow causes the lever portions 210 to contact the outer hide, muscle, or bone of the target animal. As the arrow continues to move forward, the force applied by the hide, muscle, or bone against the lever portions 210 forces those elements backward, thus pivoting P open the blades 206. Once the blades 206 pivot P sufficiently, the retention member 216 ruptures or breaks, allowing the leading tips 220 to protrude beyond an outer diameter of the arrowhead 204. Unsharpened leading edges 210*a* of the lever portions 210 help ensure movement of the lever portions 210, as opposed to further cutting that may occur with sharpened leading edges of the levers of prior art systems. As the leading tips 220 of the blades 206 contact the muscle tissue, the blades 206 open rapidly while advancement of the arrow continues. Further opening of the blades 206 exposes a greater length of the inner edge 212*a* to the internal muscular structure, organs, etc., again increasing the lethality of the shot. In certain instances, due to the length of the blades 206, the blades 206 may penetrate beyond the ribs of a target animal. Once the lever portion 210 contacts the rib bones, expansion of the blades begins within the chest cavity of the target animal, causing considerable damage therein.

Figure 3:
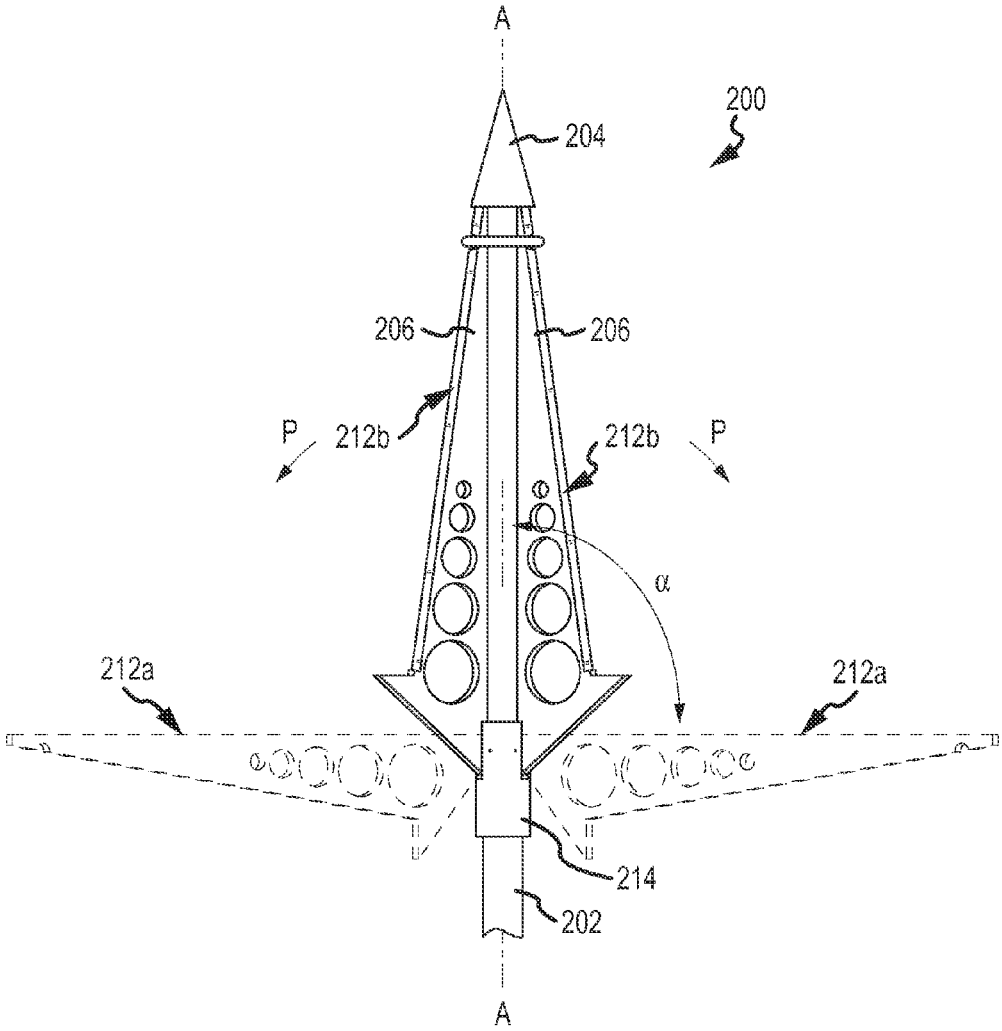
FIG. 3 is a top view of the mechanical broadhead of FIGS. 2A-2C.

FIG. 2C depicts the blade system 200 in a fully-open or deployed position. This open position may be defined by the furthest range of rotation of the blades 206. Contact between the blades 206 and the blade system body 214 (in this case a rear portion of the slots 222) may limit the final open position of the blades 206. FIG. 3 depicts a top view blade system 200 of FIGS. 2A-2C. In certain embodiments, the open position may be reached when the inner edge 212*a* of the blades 206 are at an angle $\alpha$ approximately orthogonal to the axis A of the body 214. In alternative embodiments, the inner edges 212*a* of the blades 206 may be at an angle $\alpha$ of about 80° to about 100°. Other ranges are contemplated. Of course, the blades 206 need not reach the full open position during penetration of the target, although the force of penetration and the pivoting movement P of the blades 206 make this likely.

Materials for the blade systems disclosed herein may be those known in the art. For example, the body may be manufactured of injection molded robust plastics such as those used typically used to manufacture arrow shafts. Additionally, the bodies may be made of lightweight aluminum or other metals. The blades may be manufactured of ceramic form, ceramic, or ceramic composites, or from high density plastics. More desirable, however, may be blades made from durable metals such as steel, stainless steel, titanium, brass, etc. Other non-corrosive materials may be utilized as desired for a particular application. Additionally, the blade systems described herein may include one, two, three, or more blades, blades having different lengths, or multiple rows of blades to open at different depths within a target. In that regard, the total number of blades utilized may be limited by projectile size, geometry, and/or weight, or other factors apparent to a person of skill in the art. The individual blades may have serrated or smooth cutting edges. While blade systems having outer cutting edges that project outward from the arrow shaft may be more desirable, embodiments having outer edges closer to the arrow shaft (that is, thinner blades) are also contemplated. The lever is but one mechanism that could be used to cause the blades to deploy after penetration. An alternative opening mechanism includes one or more springs that bias the blades into a deployed position. A catch may release the blade upon sufficient penetration, thus allowing the spring to deploy the blade.

While there have been described herein what are to be considered exemplary and preferred embodiments of the present technology, other modifications of the technology will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the technology. Accordingly, what is desired to be secured by Letters Patent is the technology as defined and differentiated in the following claims, and all equivalents.

What is claimed is:

1. A blade system for a projectile, the blade system comprising:

a body comprising a front portion and a rear portion and an axis extending axially from the front portion to the rear portion;

a blade pivotably secured to the body, wherein the blade comprises:

an outer cutting edge;

an inner cutting edge; and a lever proximate a rear portion of the blade, wherein an application of a force to the lever pivots the blade from a closed position toward an open position, wherein the lever comprises an unsharpened leading edge.

2. The blade system of claim 1, wherein the body is adapted to be secured to at least one of an arrow shaft and an arrowhead.

3. The blade system of claim 1, wherein the body is integral with at least one of an arrow shaft and an arrowhead.

4. The blade system of claim 1, wherein when in the closed position, the inner cutting edge is located proximate the axis.

5. The blade system of claim 4, wherein the body defines a slot, wherein when in the closed position, the inner cutting edge is located within the slot and the outer cutting edge is exposed.

6. The blade system of claim 1, wherein when in the open position, the inner cutting edge extends substantially orthogonal from the axis.

7. The blade system of claim 1, further comprising a retention element for releasably holding the blade in the closed position.

8. The blade system of claim 1, further comprising a breakable retention member, and wherein the blade further comprises a notch, and wherein the retention member is located in the notch when the blade is in the closed position.

9. The blade system of claim 8, wherein the retention member is adapted to break when the blade moves from the closed position to an intermediate position.

10. The blade system of claim 1, wherein the blade comprises a plurality of blades.

11. The blade system of claim 1, further comprising a spring for biasing the blade toward the open position.

12. An arrow comprising the blade system of claim 1.

13. An arrowhead comprising the blade system of claim 1.

* * * * *